US008965249B2

(12) United States Patent
Nogami et al.

(10) Patent No.: US 8,965,249 B2
(45) Date of Patent: Feb. 24, 2015

(54) CHARGING DEVICE CONFIGURED TO PRODUCE CORONA DISCHARGE

(71) Applicants: Hidekazu Nogami, Nagoya (JP); Masato Kobayashi, Nagoya (JP)

(72) Inventors: Hidekazu Nogami, Nagoya (JP); Masato Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/139,190

(22) Filed: Dec. 23, 2013

(65) Prior Publication Data

US 2014/0186069 A1 Jul. 3, 2014

(30) Foreign Application Priority Data

Dec. 27, 2012 (JP) ..... 2012-285634

(51) Int. Cl.
*G03G 15/02* (2006.01)

(52) U.S. Cl.
CPC ..... *G03G 15/0291* (2013.01); *G03G 15/0225* (2013.01); *G03G 2215/027* (2013.01)
USPC ..... 399/170; 399/93; 399/171; 399/172

(58) Field of Classification Search
CPC ..... G03G 15/0258; G03G 15/052
USPC ..... 399/93, 98, 170–173
See application file for complete search history.

(56) References Cited

U.S. PATENT DOCUMENTS 3,471,695 A * 10/1969 Cranch et al.
3,862,420 A * 1/1975 Banks et al. ..... 250/324
3,983,393 A * 9/1976 Thettu et al. ..... 250/326
4,143,965 A * 3/1979 Ando et al.
4,646,196 A * 2/1987 Reale
4,725,731 A * 2/1988 Lang ..... 250/326
4,910,637 A * 3/1990 Hanna
5,018,045 A * 5/1991 Myochin et al.
5,250,992 A * 10/1993 Tsuneeda et al. ..... 399/172
5,568,230 A * 10/1996 Reddy et al.
2009/0074463 A1* 3/2009 Nishio et al. ..... 399/170

FOREIGN PATENT DOCUMENTS

JP 61113080 A * 5/1986
JP 01237569 A * 9/1989
JP H04-53978 A 2/1992
JP 2000-259012 A 9/2000
JP 2003-307915 A 10/2003
JP 2006-106453 A 4/2006

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A charging device includes a discharging electrode, grid electrode, pair of shielding electrodes, frame, airflow-generating electrode, and impurity-removing member. The discharging electrode produces a corona discharge to charge a surface of photosensitive member. A first voltage is applied to the grid electrode. The discharging electrode is positioned between the shielding electrodes. The frame includes a pair of side walls confronting with each other in the moving direction. The discharging electrode and the pair of shielding electrodes are positioned between the side walls. The airflow-generating electrode is disposed at a position opposite to the discharging electrode with respect to the grid electrode. The airflow-generating electrode is applied with a second voltage lower than the first voltage. The impurity-removing member is provided on an inner surface of the frame. The impurity-removing member and the airflow-generating electrode are positioned on an identical side of the shielding electrodes in the moving direction.

7 Claims, 3 Drawing Sheets

CHARGING DEVICE CONFIGURED TO PRODUCE CORONA DISCHARGE

CROSS REFERENCE TO RELATED APPLICATION

This application claims priority from Japanese Patent Application No. 2012-285634 filed Dec. 27, 2012. The entire content of the priority application is incorporated herein by reference.

TECHNICAL FIELD

The present invention relates to a charging device.

BACKGROUND

A well-known charging device used in an image-forming device is disposed in confrontation with a photosensitive member, such as a photosensitive drum, and applies a charge to the photosensitive member through corona discharge. One such charging device disclosed in Japanese unexamined patent application publication No. 2006-106453 is provided with a discharge electrode for producing a corona discharge, a grid electrode that regulates the charge applied to the photosensitive member to a prescribed potential, a pair of shielding plates arranged parallel to each other on opposing sides of the discharge electrode, and a housing member for accommodating these components. This charging device is also provided with an ozone-removing member for removing ozone from between the housing member and shielding plates.

SUMMARY

However, unless a fan or the like is used to generate airflow within the charging device, the majority of air in the device normally just eddies around the discharge electrode (between the pair of shielding plates). In the conventional structure of the charging device described above, only a portion of the air in the device passes through the ozone-removing member. Hence, the efficiency of the ozone-removing member is not actually that high. Further, silicon compounds and the like that enter the charging device and become deposited on the discharge electrode can degrade the charging performance of the device. Therefore, it is preferable to remove the compounds by actively discharging them or circulating them toward a special removing member before the compounds become deposited on the discharge electrode.

In view of the foregoing, it is an object of the present invention to provide a charging device capable of efficiently removing impurities introduced inside the frame or housing of the charging device.

In order to attain the above and other objects, the invention provides a charging device disposed in confrontation with a photosensitive member provided in an image forming device. The charging device includes a discharging electrode, a grid electrode, a pair of shielding electrodes, a frame, an airflow-generating electrode, and an impurity-removing member. The discharging electrode is configured to produce a corona discharge to charge a surface of the photosensitive member. The grid electrode is disposed between the photosensitive member and the discharging electrode. A first voltage is applied to the grid electrode. The pair of shielding electrodes confronts with each other in a moving direction of the surface of the photosensitive member. The discharging electrode is positioned between the pair of shielding electrodes. The frame includes a pair of side walls confronting with each other in the moving direction. The discharging electrode and the pair of shielding electrodes are positioned between the pair of side walls. The airflow-generating electrode is disposed at a position opposite to the discharging electrode with respect to the grid electrode. The airflow-generating electrode is configured to be applied with a second voltage lower than the first voltage. The impurity-removing member is provided on an inner surface of the frame and configured to remove impurities entering into a space between the pair of side walls. At least a part of the impurity-removing member and the airflow-generating electrode are positioned on an identical side of the shielding electrodes in the moving direction.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

Next, a first embodiment of the present invention will be described in detail while referring to FIGS. 1 and 2. First, the general structure of a laser printer 1 will be described. Then, a detailed description will be given of a charging device 100 provided in the laser printer 1 according to the first embodiment of the invention. Directions given in the following description will be based on the perspective of a user operating the laser printer 1. Specifically, the right side of the laser printer 1 in FIG. 1 will be considered the "front," the left side the "rear," the near side the "left side," and the far side the "right side." Further, the "top" and "bottom" of the laser printer 1 in the following description will be based on the vertical directions in FIG. 1.

General Structure of the Laser Printer

Figure 1:
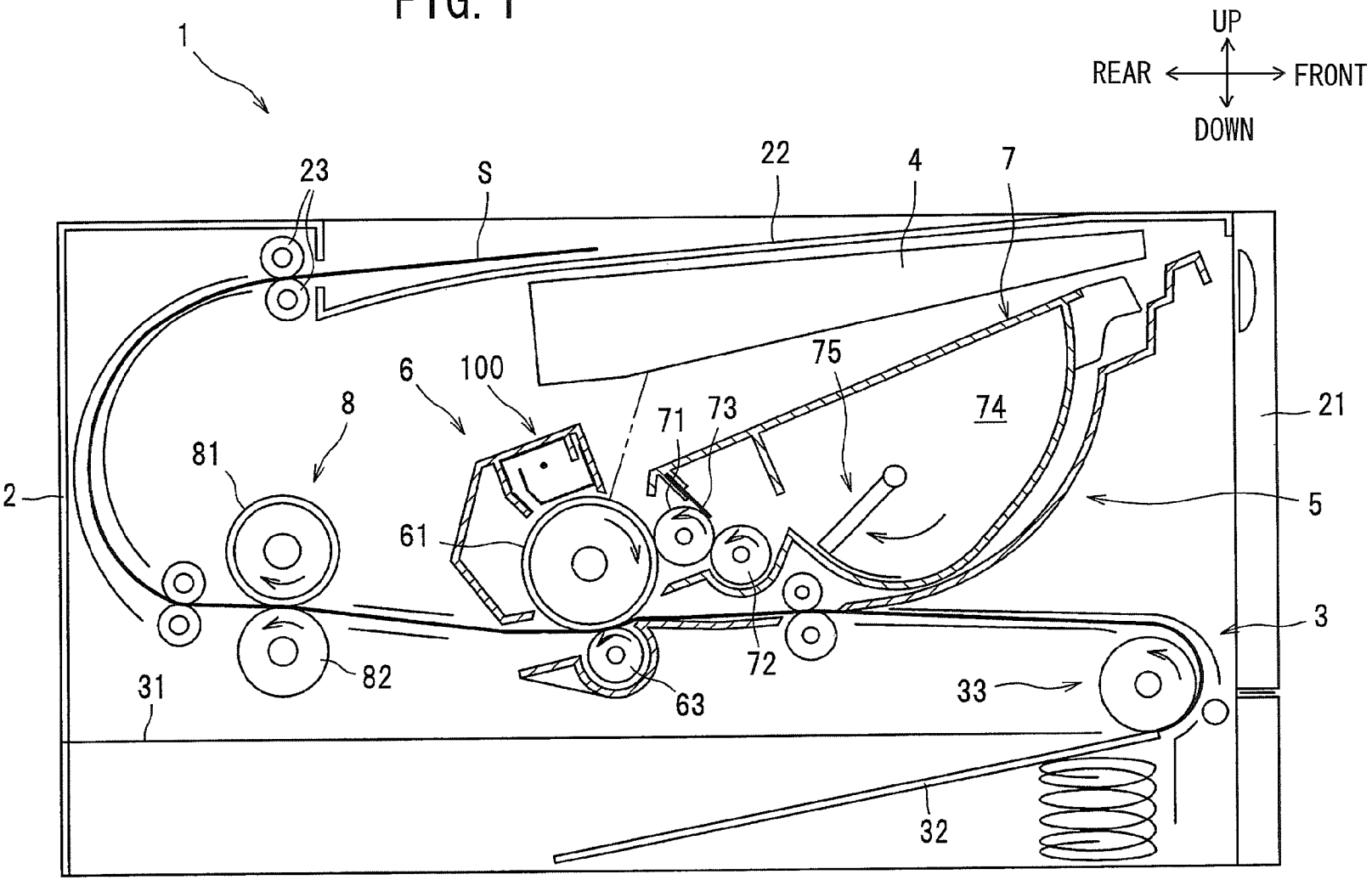
FIG. 1 is an explanatory diagram showing an image forming device including a charging device according to a first embodiment of the present invention.

As shown in FIG. 1, the laser printer 1 includes a main casing 2 and, within the main casing 2, a sheet-feeding unit 3 for supplying sheets S of paper to be printed, an exposure unit 4, a process cartridge 5 for transferring toner images onto the sheets S, and a fixing unit 8 for fixing the toner images on the sheets S with heat.

The sheet-feeding unit 3 is provided in the bottom section of the main casing 2 and primarily includes a paper tray 31 accommodating the sheets S, a paper-pressing plate 32, and a paper-feeding mechanism 33. The paper-pressing plate 32 is disposed below the sheets S provided in the paper tray 31 for urging the front end of the sheets S upward, and the paper-feeding mechanism 33 supplies the sheets S from the paper tray 31 to the process cartridge 5 while separating the sheets S so that one sheet is fed at a time.

The exposure unit 4 is disposed in the top section of the main casing 2 and includes a laser light source (not shown), a polygon mirror, lenses, reflecting mirrors, and the like. The laser light source in the exposure unit 4 emits a laser beam (indicated by a chain line in FIG. 1) based on image data, scanning the laser beam over the surface of a photosensitive drum 61 described later at a high speed to expose the same.

The process cartridge 5 is disposed below the exposure unit 4. A front cover 21 provided on the front side of the main casing 2 can be opened to expose an opening through which the process cartridge 5 can be mounted in or removed from the main casing 2. The process cartridge 5 is configured of a photosensitive unit 6, and a developing unit 7.

The photosensitive unit 6 is primarily configured of a positive-charging photosensitive drum 61, a charging device 100, and a transfer roller 63. The developing unit 7 is detachably mounted on the photosensitive unit 6. The developing unit 7 is primarily configured of a developing roller 71, a supply roller 72, a thickness-regulating blade 73, a toner-accommodating section 74, and an agitator 75.

With the process cartridge 5 having this construction, first the charging device 100 applies a uniform positive charge to the surface of the photosensitive drum 61, and the charged surface is subsequently exposed to a laser beam emitted from the exposure unit 4 and scanned at a high speed over the charged surface, forming an electrostatic latent image on the surface of the photosensitive drum 61 based on image data. In the meantime, as the agitator 75 agitates toner inside the toner-accommodating section 74, some of the toner is supplied onto the supply roller 72, which in turn supplies the toner onto the developing roller 71. As the developing roller 71 continues to rotate, toner supplied to the surface thereof passes under the thickness-regulating blade 73, and the thickness-regulating blade 73 regulates the toner carried on the developing roller 71 to a uniform thin layer.

Toner carried on the surface of the developing roller 71 is supplied to the electrostatic latent image formed on the surface of the photosensitive drum 61, thereby developing the latent image into a visible toner image. This toner image is subsequently transferred onto a sheet S supplied by the sheet-feeding unit 3 as the sheet S passes between the photosensitive drum 61 and transfer roller 63.

The fixing unit 8 is disposed on the rear side of the process cartridge 5. The fixing unit 8 primarily includes a heating roller 81, and a pressure roller 82 disposed in confrontation with the heating roller 81 and applying pressure to the same. The fixing unit 8 having this construction thermally fixes toner images to sheets S after the transfer operation as the sheets S pass between the heating roller 81 and pressure roller 82. After the toner image is fixed to a sheet S, discharge rollers 23 discharge the sheet S into a discharge tray 22.

Detailed Description of the Charging Device

Figure 2:
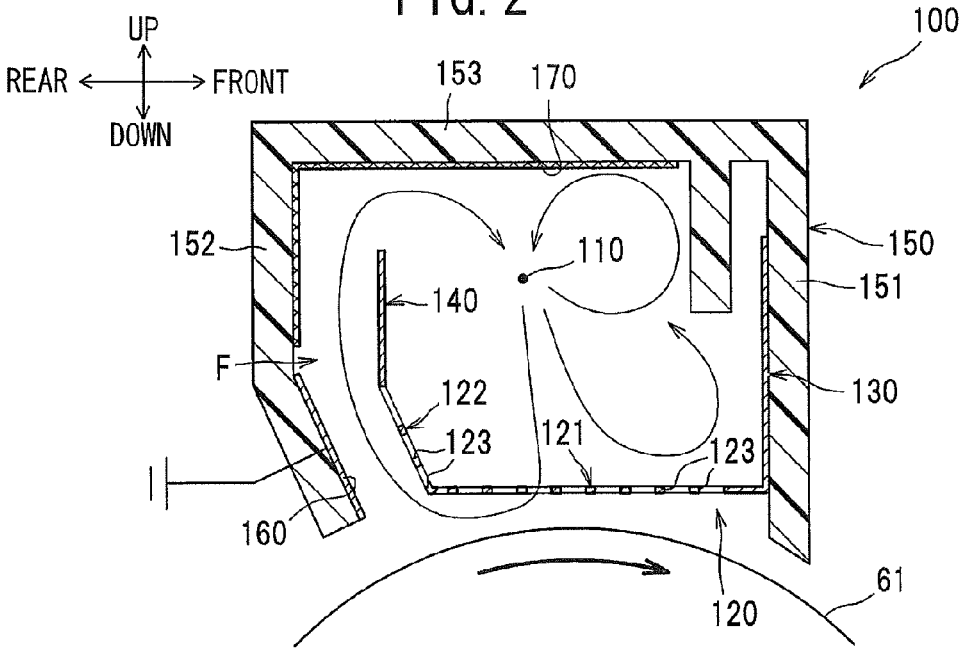
FIG. 2 is an explanatory diagram showing the charging device according to the first embodiment.

As shown in FIG. 2, the charging device 100 is disposed at a position confronting but separated from the photosensitive drum 61 provided in the laser printer 1. The charging device 100 is primarily configured of a discharge electrode 110, a grid electrode 120, a pair of shielding electrodes 130 and 140, a frame 150, an airflow-generating electrode 160, and an impurity-removing member 170.

The discharge electrode 110 is in the form of a wire and is configured to produce a corona discharge when a prescribed voltage (charging bias) is applied thereto. The discharge electrode 110 is stretched taut in the left-right direction (i.e., the axial direction of the photosensitive drum 61). The discharge electrode 110 produces positively charged particles, such as nitrogen ions, on the surface of the photosensitive drum 61 through corona discharge.

The grid electrode 120 is a plate-shaped electrode disposed between the photosensitive drum 61 and discharge electrode 110. By setting the potential of the grid electrode 120 to a value (including 0) different from the discharge electrode 110, the grid electrode 120 can control the amount of charge applied to the surface of the photosensitive drum 61. The grid electrode 120 includes a first grid electrode 121 extending in the front-rear direction, which is the general direction in which the surface portion of the photosensitive drum 61 in confrontation with the charging device 100 moves (as indicated by a bold arrow); and a second grid electrode 122 extending from the rear edge of the first grid electrode 121 in a direction sloping upward toward the rear portion of the frame, hence, away from the photosensitive drum 61. The first and second grid electrodes 121 and 122 each have a plurality of grid holes 123 through which the charged particles produced by the discharge electrode 110 can pass.

The shielding electrodes 130 and 140 are plate-shaped electrodes formed integrally with the grid electrode 120. The shielding electrodes 130 and 140 are arranged parallel to each other and are disposed on opposite sides of the discharge electrode 110 in the front-rear direction. More specifically, the shielding electrode 130 extends upward from the front edge of the first grid electrode 121 so as to be substantially orthogonal to the first grid electrode 121. The shielding electrode 140 extends upward from the top edge of the second grid electrode 122 so as to be substantially parallel to the shielding electrode 130.

The frame 150 is formed of a dielectric material, such as a resin, and functions to support the various electrodes, including the discharge electrode 110 and the airflow-generating electrode 160 described below. The frame 150 is configured of a pair of side walls 151 and 152 spaced apart from each other in the front-rear direction, with one disposed on each side of the discharge electrode 110 and the shielding electrodes 130 and 140; and a top wall 153 that connects the upper edges of the side walls 151 and 152.

The side wall 151 constitutes the front wall of the frame 150. The shielding electrode 130 is disposed along the inner surface of the side wall 151. The side wall 152 constitutes the rear wall of the frame 150. The top wall 153 constitutes the upper wall of the frame 150 and is arranged so as to cover the discharge electrode 110, grid electrode 120, and shielding electrodes 130 and 140. The top wall 153 is connected to the side walls 151 and 152. In the first embodiment, the top wall 153 of the frame 150 covers the side of the discharge electrode 110 opposite the side on which the photosensitive drum 61 is provided, thereby reducing the amount of impurities that are allowed to enter the frame 150.

The side wall 152 is disposed and shaped so that a prescribed gap separates the side wall 152 from the shielding electrode 140 and the second grid electrode 122. A prescribed gap is also formed between the top wall 153 and the top edge of the shielding electrode 140. This configuration forms a flow channel F between the side wall 152 and top wall 153 and the shielding electrode 140 and second grid electrode 122.

In the first embodiment, the frame 150 is integrally formed with the frame portion of the photosensitive unit 6 (see FIG. 1), but the frame 150 may be formed separately from the frame of the photosensitive unit 6.

The airflow-generating electrode 160 is a plate-shaped electrode that is supported on the frame 150 on the opposite side of the grid electrode 120 from the discharge electrode 110. More specifically, the airflow-generating electrode 160 is supported on the portion of the side wall 152 opposing (in confrontation with) the second grid electrode 122 and is substantially parallel to the same. A voltage (voltage for attracting charged particles generated in the corona discharge) lower than the voltage applied to the grid electrode 120 is applied to the airflow-generating electrode 160. With respect to the vertical direction, the airflow-generating electrode 160 is disposed between the photosensitive drum 61 and the portion of the flow channel F defined by the side wall 152 and shielding electrode 140 with respect to the vertical. In the first embodiment, the airflow-generating electrode 160 is provided on the rear side of the discharge electrode 110 with respect to the front-rear direction and, hence, on the upstream side of the discharge electrode 110 with respect to the direction that the surface of the photosensitive drum 61 moves (indicated by the bold arrow).

As an example, if a voltage of 5 kV is applied to the discharge electrode 110 and a voltage of 700 V is applied to the grid electrode 120, then the voltage applied to the airflow-generating electrode 160 is preferably no greater than 0 V.

The impurity-removing member 170 is provided as a coating over part of the inner surface of the frame 150 and functions to remove impurities from between the side walls 151 and 152 (from within the frame 150). More specifically, the impurity-removing member 170 is provided over the inner surface of the top wall 153 and the upper portion on the inner surface of the side wall 152. With this configuration, a portion of the impurity-removing member 170 is provided in the rear side of the frame 150 (the identical side on which the airflow-generating electrode 160 is provided) with respect to the front-rear direction, i.e., the direction in which the shielding electrodes 130 and 140 oppose each other. Further, at least a part of the impurity-removing member 170 is provided on the portion of the inner surface of the side wall 152 defining the flow channel F.

The impurity-removing member 170 may be formed of a material that adsorbs impurities, a material that decomposes impurities, or a material that combines these properties and is preferably a material suitable for the type of impurity that needs to be removed. Activated carbon or another porous material may be used to adsorb impurities, while a catalytically active material can be employed to decompose impurities.

For example, the impurity-removing member 170 may be formed of activated carbon or the like when the impurity being removed is siloxane gas, and the activated carbon may be impregnated with polystyrene or a similar material to enhance its ability to adsorb siloxane. If the impurity being removed is ozone, the impurity-removing member 170 may be formed of a material including activated carbon or a compound capable of decomposing ozone, such as manganese dioxide or nickel oxide.

To provide the impurity-removing member 170 in the frame 150, the material constituting the impurity-removing member 170 may be formed in a sheet and the sheet may be affixed to the inner surface of the frame 150. Alternatively, the material composing the impurity-removing member 170 may be coated over the inner surface of the frame 150.

Next, the operations and effects of the charging device 100 according to the first embodiment will be described. When the charging bias is applied to the discharge electrode 110 to produce a corona discharge, a voltage is applied to the airflow-generating electrode 160 that is lower than the voltage applied to the grid electrode 120. Accordingly, some of the charged particles produced through corona discharge migrate from the vicinity of the discharge electrode 110 toward the airflow-generating electrode 160. As a result, air between the shielding electrodes 130 and 140 flows from the discharge electrode 110 toward the airflow-generating electrode 160. This airflow then continues through the flow channel F and returns to the area between the shielding electrodes 130 and 140. As shown in FIG. 2, various airflows are produced in the frame 150 through this configuration, as indicated by the arrows.

Using these airflows, the charging device 100 can effectively adsorb or decompose impurities in the frame 150 by circulating the impurities toward the impurity-removing member 170 so that they come into contact with the surface of the impurity-removing member 170. Further, by providing an airflow that flows out of the frame 150, the charging device 100 can exhaust impurities from the frame 150. Thus, the charging device 100 according to the first embodiment can efficiently remove impurities from the frame 150.

Further, since the airflow-generating electrode 160 is positioned so as to oppose the second grid electrode 122 in the first embodiment, the airflow-generating electrode 160 is arranged to slope upward and rearward away from the photosensitive drum 61. This arrangement reduces the effect that the airflow-generating electrode 160 has on the charged photosensitive drum 61 when a voltage is applied to the airflow-generating electrode 160.

Further, since the airflow-generating electrode 160 is provided on the upstream side of the discharge electrode 110 with respect to the rotating direction of the photosensitive drum 61, charged particles produced through corona discharge can migrate from the discharge electrode 110 toward the airflow-generating electrode 160 with little effect from the surface potential on the photosensitive drum 61 since the surface potential on the upstream side is low. Accordingly, this configuration forms a strong airflow from the discharge electrode 110 to the airflow-generating electrode 160 for removing impurities from the frame 150 more efficiently.

Figure 3:
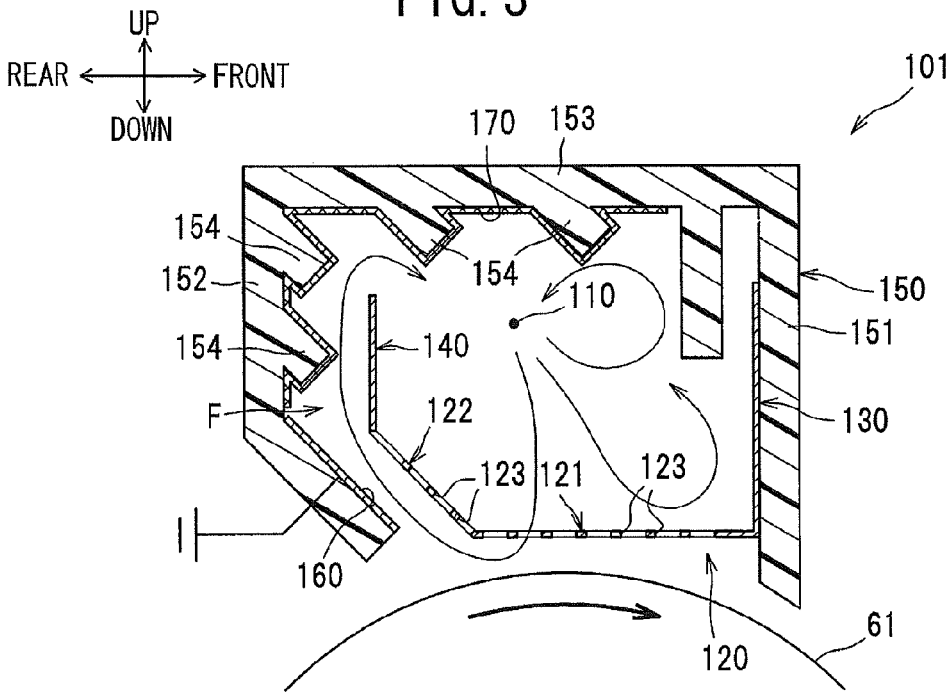
FIG. 3 is an explanatory diagram showing a charging device according to a modification of the first embodiment.

Note that the charging device of the present invention is not limited to the structure of the charging device 100 described in the first embodiment. For example, a charging device 101 shown in FIG. 3 has ribs 154 disposed on the inner surfaces of the side wall 152 and top wall 153 constituting the frame 150. The ribs 154 protrude inward into the frame 150. With this configuration, the impurity-removing member 170 is provided over the inner surfaces of the side wall 152 and top wall 153 and the surfaces of the ribs 154. This configuration increases the surface area of the impurity-removing member 170 so that impurities can be removed from the frame 150 with greater efficiency.

Second Embodiment

Figure 4:
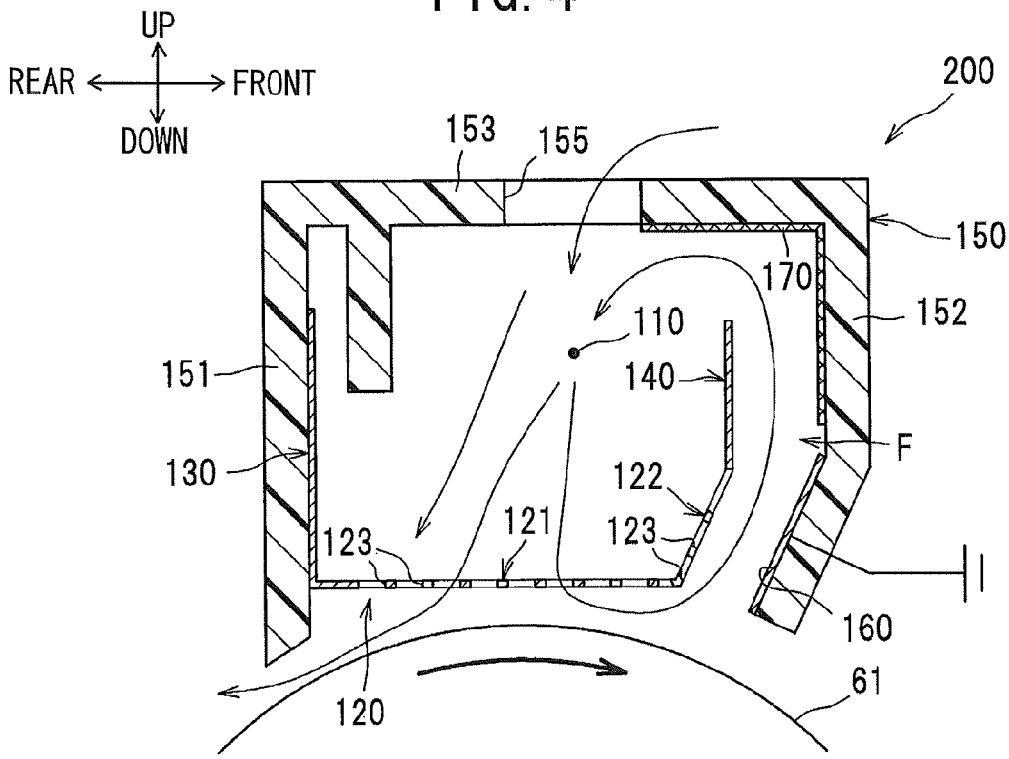
FIG. 4 is an explanatory diagram showing a charging device according to a second embodiment of the present invention.

Next, a second embodiment of the present invention will be described, wherein like parts and components are designated with the same reference numerals to avoid duplicating description. As shown in FIG. 4, a charging device 200 of the second embodiment has general front-rear symmetry with the charging device 100 according to the first embodiment (see FIG. 2).

The frame 150 of the charging device 200 has a through hole 155 formed in the top wall 153, which is on the side of the discharge electrode 110 opposite the photosensitive drum 61. The through hole 155 provides communication between the interior and exterior of the frame 150. With this configuration, air can flow into the frame 150 through the through hole 155, pass around the discharge electrode 110, flow through the grid holes 123 formed in the grid electrode 120, and flow out of the frame 150 through the gap formed between the frame 150 and the photosensitive drum 61.

A fan (not shown) may be provided in the laser printer 1 (see FIG. 1) for generating airflow in the frame 150. For example, an exhaust fan may be provided in the main casing 2 to the rear of the charging device 200 for exhausting air from the main casing 2. In this case, the exhaust fan will draw air out of the frame 150, producing airflow from the through hole 155 to the gap between the frame 150 and photosensitive drum 61. Alternatively, a supply fan may be provided near the through hole 155 for feeding air into the frame 150. This configuration also produces airflow from the through hole 155 to the gap between the frame 150 and photosensitive drum 61.

The charging device 200 according to the second embodiment can obtain the same operational advantages as the charging device 100 in the first embodiment described above. In addition, since the charging device 200 of the second embodiment produces airflow having a large flow rate around the discharge electrode 110, the charging device 200 can rapidly reduce the concentration of impurities around the discharge electrode 110. Accordingly, the charging device 200 can reduce the amount of impurities that become deposited on the discharge electrode 110.

While the invention has been described in detail with reference to the first and second embodiments thereof, it would be apparent to those skilled in the art that various changes and modifications may be made therein without departing from the spirit of the invention.

In the first and second embodiments described above, the flow channel F is formed between the shielding electrode 140 and frame 150, but the present invention is not limited to this configuration. For example, a flow channel may be formed between the shielding electrode 130 and the frame 150 and between the shielding electrode 140 and the frame 150. In this case, another airflow-generating electrode should be provided between the photosensitive drum 61 and the flow channel F formed between the shielding electrode 140 and the frame 150. In addition, it is preferable to provide the impurity-removing member along the portion of the inner surface of the frame in which the flow channels are formed.

In the first and second embodiments described above, the impurity-removing member 170 is provided on the inner surfaces of the side wall 152 (the flow channel F) and the top wall 153, but the impurity-removing member 170 may be provided only on the side wall 152, that is, only on portion of the frame 150 that forms the flow channel on the same side as the airflow-generating electrode 160. Further, while the impurity-removing member 170 is provided on a portion of the inner surface of the frame 150 in the first embodiment, the impurity-removing member may be provided over the entire inner surface of the frame, for example.

While the frame 150 of the first and second embodiments described above is configured of a pair of side walls 151 and 152 and a top wall 153, the frame 150 may be configured of only the pair of side walls disposed parallel to each other and separated in the direction that the opposing surface of the photosensitive drum moves.

While the grid electrode 120 and the shielding electrodes 130 and 140 are formed integrally in the embodiments described above, the present invention is still applicable when these components are provided as separate members.

The discharge electrode described in the first and second embodiments is the wire-like discharge electrode 110, but the discharge electrode may be configured of a plurality of needle electrodes arranged in a line extending along a prescribed direction. In other words, the charging device of the present invention may be a pin array charger.

In the embodiments described above, the present invention is applied to a system for positively charging the photosensitive drum 61, but the present invention may also be applied to systems that negatively charge the photosensitive member.

The image-forming device in the embodiments employing the charging device of the present invention is a laser printer 1 capable of forming only monochrome images, but the image-forming device of the present invention may be a printer capable of forming color images. Further, the image-forming device is not limited to printers, but may be a copy machine or multifunction peripheral provided with an original-reading device, such as a flatbed scanner, for example.

Working Example

Next, a working example (the results of a simulation) that substantiates the effects of the invention will be described. In this working example, airflow generated in the frame of the charging device was simulated under the following conditions.

Conditions of Simulation

Charging device employed: a device with the same structure as the charging device 100 in the first embodiment Voltage applied to discharge electrode: 6 kV Voltage applied to grid electrode: 700 kV Voltage applied to airflow-generating electrode: −1 kV Corona current: 250 μA The corona current denotes the total amount of electric current generated from the surface of the wire (discharge electrode) during a corona discharge.

Results of the Simulation

Figure 5:
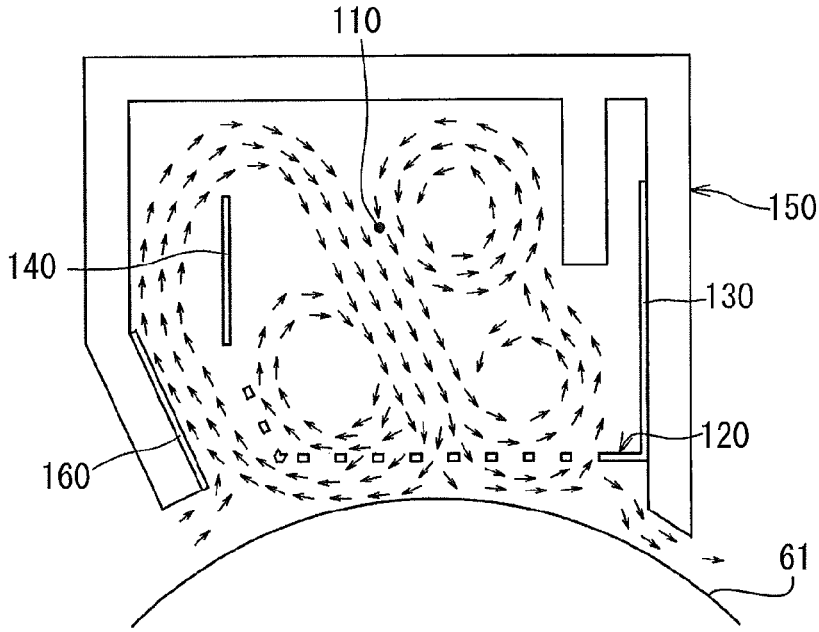
FIG. 5 is an explanatory diagram showing an example of simulation result of air flow in the charging device.

As shown in FIG. 5, a simulation performed on the charging device of the invention confirmed that air flows in eddies in the vicinity of the discharge electrode within the frame of the charging device. In addition, air was found to flow from the vicinity of the discharge electrode through the grid holes formed in the grid electrode toward the airflow-generating electrode. It was further confirmed that air flows through the channel formed between one shielding electrode and the frame and flows back into the area between the pair of shielding electrodes. Another airflow was confirmed to pass out of the frame through a gap between the frame and the photosensitive drum.

Owing to the airflows described above, the charging device of the present invention can exhaust impurities from the frame of the charging device and can circulate impurities to the impurity-removing member provided on the inner surface of the frame. Hence, the simulation confirmed that the charging device of the present invention can remove impurities from the frame efficiently.

What is claimed is:

1. A charging device disposed in confrontation with a photosensitive member provided in an image forming device, the charging device comprising:

a discharging electrode configured to produce a corona discharge to charge a surface of the photosensitive member;

a grid electrode disposed between the photosensitive member and the discharging electrode, a first voltage being applied to the grid electrode;

a pair of shielding electrodes confronting with each other in a moving direction of the surface of the photosensitive member, the discharging electrode being positioned between the pair of shielding electrodes;

a frame including a pair of side walls confronting with each other in the moving direction, the discharging electrode and the pair of shielding electrodes being positioned between the pair of side walls;

an airflow-generating electrode disposed at a position opposite to the discharging electrode with respect to the grid electrode, and configured to be applied with a second voltage lower than the first voltage; and an impurity-removing member provided on an inner surface of the frame and configured to remove impurities entering into a space between the pair of side walls, at least a part of the impurity-removing member and the airflow-generating electrode being positioned on an identical side of the shielding electrodes in the moving direction.

2. The charging device according to claim 1, wherein at least one of the pair of shielding electrodes and the frame are disposed so as to define a prescribed gap therebetween, thereby defining a flow channel between the at least one of the pair of shielding electrodes and the frame;

wherein at least a part of the impurity-removing member is disposed on at least a part of the inner surface of the frame defining the flow channel; and wherein the airflow-generating electrode is disposed between the flow channel and the photosensitive member.

3. The charging device according to claim 1, wherein grid electrode includes a first grid electrode and a second grid electrode, the first grid electrode extending in the moving direction, and the second grid electrode extending in a direction sloping away from the photosensitive member with respect to the first grid electrode; and wherein the airflow-generating electrode is disposed in confrontation with the second grid electrode.

4. The charging device according to claim 1, wherein the airflow-generating electrode is disposed upstream of the discharging electrode in the moving direction.

5. The charging device according to claim 1, wherein the frame includes a protruding portion protruding inward from the inner surface of the frame; and wherein the impurity-removing member is provided over the protruding portion and the inner surface.

6. The charging device according to claim 1, wherein the frame has a wall disposed at a position opposite to the photosensitive member with respect to the discharging electrode and connected to the pair of side walls, the pair of side walls and the wall configured to cover the discharging electrode, the grid electrode, and the pair of shielding electrodes.

7. The charging device according to claim 1, wherein the frame has a through hole disposed at a position opposite of the photosensitive member with respect to the discharging electrode, whereby air flows into the frame through the through hole, moves past the discharge electrode, and flows out of the frame through a gap formed between the frame and the photosensitive member.

* * * * *